US011988422B2

(12) United States Patent
Tay

(10) Patent No.: US 11,988,422 B2
(45) Date of Patent: May 21, 2024

(54) MICROCHANNEL HEAT EXCHANGER DRAIN

(71) Applicant: Carrier Corporation, Palm Beach Gardens, FL (US)

(72) Inventor: Lian San Tay, Singapore (SG)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/725,074

(22) Filed: Apr. 20, 2022

(65) Prior Publication Data

US 2022/0349632 A1 Nov. 3, 2022

Related U.S. Application Data

(60) Provisional application No. 63/180,927, filed on Apr. 28, 2021.

(51) Int. Cl.
*F25B 39/04* (2006.01)
*F28D 1/047* (2006.01)

(52) U.S. Cl.
CPC ..... *F25B 39/04* (2013.01); *F28D 1/0475* (2013.01); *F25B 2339/0446* (2013.01)

(58) Field of Classification Search
CPC . F25B 39/04; F25B 2339/0446; F22B 37/147
USPC ..... 165/173
See application file for complete search history.

(56) References Cited

U.S. PATENT DOCUMENTS 1,664,812 A * 4/1928 Gargiulo ..... F28D 1/00 165/149
1,877,325 A * 9/1932 Ihde ..... F28D 1/0358 165/138
1,907,032 A * 5/1933 Askin ..... B60H 1/00464 165/41
2,242,491 A * 5/1941 Van Brunt ..... F23J 1/00 122/235.13
2,308,119 A * 1/1943 Spieth ..... F28F 9/262 165/DIG. 53
2,553,143 A * 5/1951 McNeely ..... F24F 13/22 62/93
3,427,227 A 2/1969 Chamberlin
3,766,891 A * 10/1973 Csathy ..... F22B 1/1807 122/149
3,875,904 A * 4/1975 Astrom ..... F23J 3/00 122/379

(Continued)

FOREIGN PATENT DOCUMENTS

CN 103058301 A 4/2013
CN 102580334 B 8/2014

(Continued)

OTHER PUBLICATIONS

European Search Report; European Application No. 22170142.8; dated Sep. 15, 2022; 7 pages.

*Primary Examiner* — Raheena R Malik
(74) *Attorney, Agent, or Firm* — CANTOR COLBURN LLP

(57) ABSTRACT

A heat exchanger includes a first manifold, a second manifold, and a body including a plurality of heat exchange tube segments arranged in spaced parallel relationship and fluidly coupling the first manifold and the second manifold. At least one opening is formed in the body. The at least one opening extends through the body.

9 Claims, 8 Drawing Sheets

(56) References Cited

U.S. PATENT DOCUMENTS 3,923,098 A * 12/1975 Ares ..... F25D 21/14 165/DIG. 201
4,232,533 A 11/1980 Lundblad et al.
4,346,560 A 8/1982 Rapier
4,391,027 A * 7/1983 Fleury ..... B23P 15/26 29/418
4,394,849 A * 7/1983 Pratt ..... F22B 37/147 122/6 A
4,563,194 A * 1/1986 Simon ..... C10J 3/86 165/169
4,673,032 A * 6/1987 Hara ..... F28D 1/05366 165/44
4,977,956 A * 12/1990 Aoki ..... F28D 1/05366 165/174
5,095,972 A * 3/1992 Nakaguro ..... F28F 9/0253 165/175
5,097,891 A * 3/1992 Christensen ..... F02B 29/0475 165/44
5,101,773 A * 4/1992 White ..... F22B 37/147 122/6.6
5,101,890 A * 4/1992 Aoki ..... F28F 9/0212 165/110
5,771,961 A * 6/1998 Alizadeh ..... F04D 29/582 165/41
6,179,043 B1 * 1/2001 Betz ..... F04D 29/582 165/41
6,405,552 B1 * 6/2002 Hubert ..... F24F 13/22 62/291
6,516,627 B2 2/2003 Ring et al.
7,552,756 B2 * 6/2009 Riniker ..... F28F 9/268 165/41
8,397,797 B2 * 3/2013 Piggott ..... F28F 9/02 165/81
8,685,205 B2 4/2014 Nellis et al.
9,038,402 B2 5/2015 Sonninen
9,062,877 B2 * 6/2015 Chen ..... F22B 29/06
9,890,977 B2 2/2018 Li et al.
9,909,818 B2 * 3/2018 Goodman ..... F28F 1/12
10,113,817 B2 * 10/2018 Spryshak ..... F28F 13/12
10,857,480 B2 12/2020 Popa
2003/0205361 A1 * 11/2003 Dey ..... F28D 1/05366 165/41
2006/0137855 A1 6/2006 Daffron
2008/0006388 A1 * 1/2008 Riniker ..... F28F 9/268 165/41
2013/0306280 A1 * 11/2013 Goodman ..... F28F 1/12 165/181
2015/0096718 A1 * 4/2015 Noel-Baron ..... F28F 17/005 165/166
2016/0195345 A1 * 7/2016 Schult ..... F28D 1/05366 62/286
2020/0103148 A1 * 4/2020 Matsumoto ..... F28D 1/053
2022/0349632 A1 * 11/2022 Tay ..... F25B 39/04

FOREIGN PATENT DOCUMENTS

CN 103127738 B 10/2014
CN 103292528 B 8/2015
CN 205569791 U 9/2016
DE 102008034123 A1 1/2010
JP 04214197 A * 8/1992
JP H04214197 A 8/1992
JP 2006343064 A 12/2006
KR 101478664 B1 1/2015
KR 101626596 B1 6/2016
WO 2005103588 A1 11/2005

* cited by examiner

MICROCHANNEL HEAT EXCHANGER DRAIN

CROSS-REFERENCE TO RELATED APPLICATIONS

This application claims the benefit of U.S. Application No. 63/180,927 filed Apr. 28, 2021, the disclosure of which is incorporated herein by reference in its entirety.

BACKGROUND

Exemplary embodiments of the present disclosure relate to a heat exchanger, and more particularly, to a heat exchanger for use in a condenser of a container refrigeration unit.

The heat rejected by a condenser coil of a container refrigeration unit is typically used to prevent water within the drain system of the unit from freezing. In existing container refrigeration units, the condenser coil is a tube-fin heat exchanger including a plurality of copper tubes extending through aligned sheets that form fins. Because the bend portion of the copper tubes cannot extend through the sheets of fins, the conduits of the drain system are routed under or behind a mainframe to avoid interference with the condenser coil. However, this indirect routing of the drain system adds complexity and cost to the system.

BRIEF DESCRIPTION

According to an embodiment, a heat exchanger includes a first manifold, a second manifold, and a body including a plurality of heat exchange tube segments arranged in spaced parallel relationship and fluidly coupling the first manifold and the second manifold. At least one opening is formed in the body. The at least one opening extends through the body.

In addition to one or more of the features described above, or as an alternative, in further embodiments the at least one opening is arranged at a central portion of the body.

In addition to one or more of the features described above, or as an alternative, in further embodiments the at least one opening is arranged at an edge of the body.

In addition to one or more of the features described above, or as an alternative, in further embodiments a bent section of at least one of the plurality of heat exchange tube segments is bent out of a plane of the at least one of the plurality of heat exchange tube segments, the at least one opening being formed by the bent section of the at least one of the plurality of heat exchange tube segments.

In addition to one or more of the features described above, or as an alternative, in further embodiments the plurality of heat exchange tube segments includes a first heat exchange tube segment having a first bent section and a second heat exchange tube segment having a second bent section, the at least one opening being defined between the first bent section and the second bent section.

In addition to one or more of the features described above, or as an alternative, in further embodiments the first bent section is bent in a first direction and the second bend section is bent in a second direction, opposite the first direction, the first bent section and the second bent section being aligned.

In addition to one or more of the features described above, or as an alternative, in further embodiments the heat exchanger further comprises a plurality of fins disposed between adjacent heat exchange tube segments of the plurality of heat exchange tube segments.

In addition to one or more of the features described above, or as an alternative, in further embodiments a fin is not connected to the at least one of the plurality of heat exchange tube segments at the bent section.

In addition to one or more of the features described above, or as an alternative, in further embodiments each of the plurality of heat exchange tube segments defines a plurality of discrete flow channels that extend over a length of the plurality of heat exchange tube segments.

In addition to one or more of the features described above, or as an alternative, in further embodiments at least one fold is formed in the plurality of heat exchange tube segments include a fold, the fold being defined about an axis extending generally perpendicular to a longitudinal axis of the plurality of heat exchange tube segments.

In addition to one or more of the features described above, or as an alternative, in further embodiments the at least one fold includes a first fold and a second fold such that the body of the heat exchanger is generally U-shaped.

In addition to one or more of the features described above, or as an alternative, in further embodiments the heat exchanger is configured to operate as a condenser in a container refrigeration unit.

According to an embodiment, a refrigeration system includes a support surface, a heat exchanger mounted to the support surface, the heat exchanger including a body and an opening extending through the body, and a drain system associated with the support surface. A portion of the drain system extends through the opening of the heat exchanger.

In addition to one or more of the features described above, or as an alternative, in further embodiments the drain system includes a conduit extendable through the opening of the heat exchanger.

In addition to one or more of the features described above, or as an alternative, in further embodiments the heat exchanger is a microchannel heat exchanger.

In addition to one or more of the features described above, or as an alternative, in further embodiments the body of the heat exchanger further comprises a plurality of heat exchange tube segments arranged in spaced parallel relationship and fluidly coupling a first manifold and a second manifold, the opening being defined by at least one of the plurality of heat exchange tube segments.

In addition to one or more of the features described above, or as an alternative, in further embodiments a bent section of at least one of the plurality of heat exchange tube segments is bent out of a plane of the at least one of the plurality of heat exchange tube segments, the opening being defined by the bent section of the at least one of the plurality of heat exchange tube segments.

In addition to one or more of the features described above, or as an alternative, in further embodiments the opening is arranged at a central portion of the body of the heat exchanger.

In addition to one or more of the features described above, or as an alternative, in further embodiments the opening is arranged at an edge of the body of the heat exchanger.

In addition to one or more of the features described above, or as an alternative, in further embodiments the refrigeration system is a container refrigeration unit.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
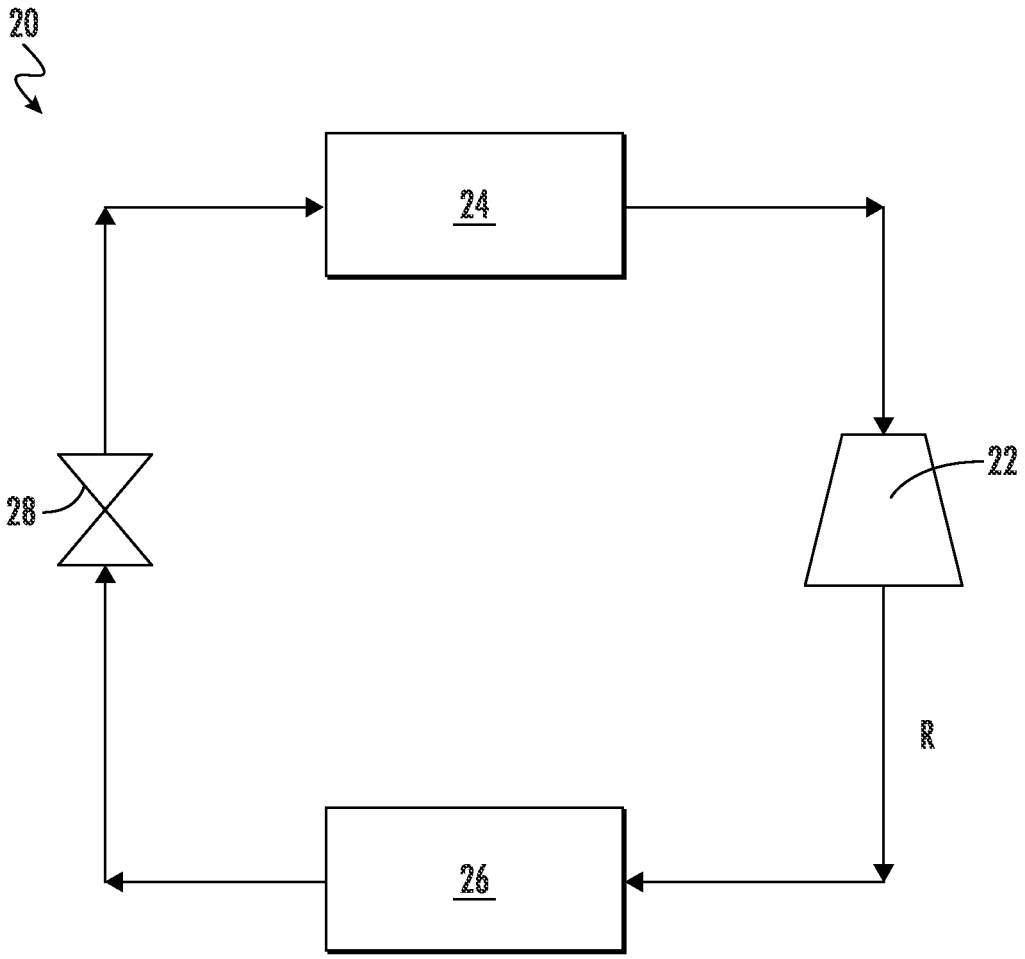
FIG. 1 is a schematic diagram of a basic vapor compression refrigeration cycle of a heating, ventilation, air conditioning, and refrigeration system.

Referring now to FIG. 1, a vapor compression cycle 20 of a heating, ventilation, air conditioning and refrigeration (HVAC&R) system is schematically illustrated. Exemplary HVAC&R systems include, but are not limited to, residential, split, packaged, chiller, rooftop, supermarket, and transport HVAC&R systems, for example. A working fluid, such as refrigerant R for example, is configured to circulate through the vapor compression cycle 20 such that the refrigerant R absorbs heat when evaporated at a low temperature and pressure and releases heat when condensed at a higher temperature and pressure.

36 Within this vapor compression cycle 20, the refrigerant flows in a counterclockwise direction as indicated by the arrow. The compressor 22 receives refrigerant vapor from the evaporator 24 and compresses it to a higher temperature and pressure, with the relatively hot vapor then passing to the condenser 26 where it is cooled and condensed to a liquid state by a heat exchange relationship with a cooling medium (not shown) such as air. The liquid refrigerant R then passes from the condenser 26 to an expansion device 28, wherein the refrigerant R is expanded to a low temperature two-phase liquid/vapor state as it passes to the evaporator 24. The relatively cold two-phase refrigerant mixture then passing to the evaporator 24 where it is boiled to a vapor state by a heat exchange relationship with a heating medium (not shown) such as air. The low pressure vapor then returns to the compressor 22 where the cycle is repeated.

Figure 2:
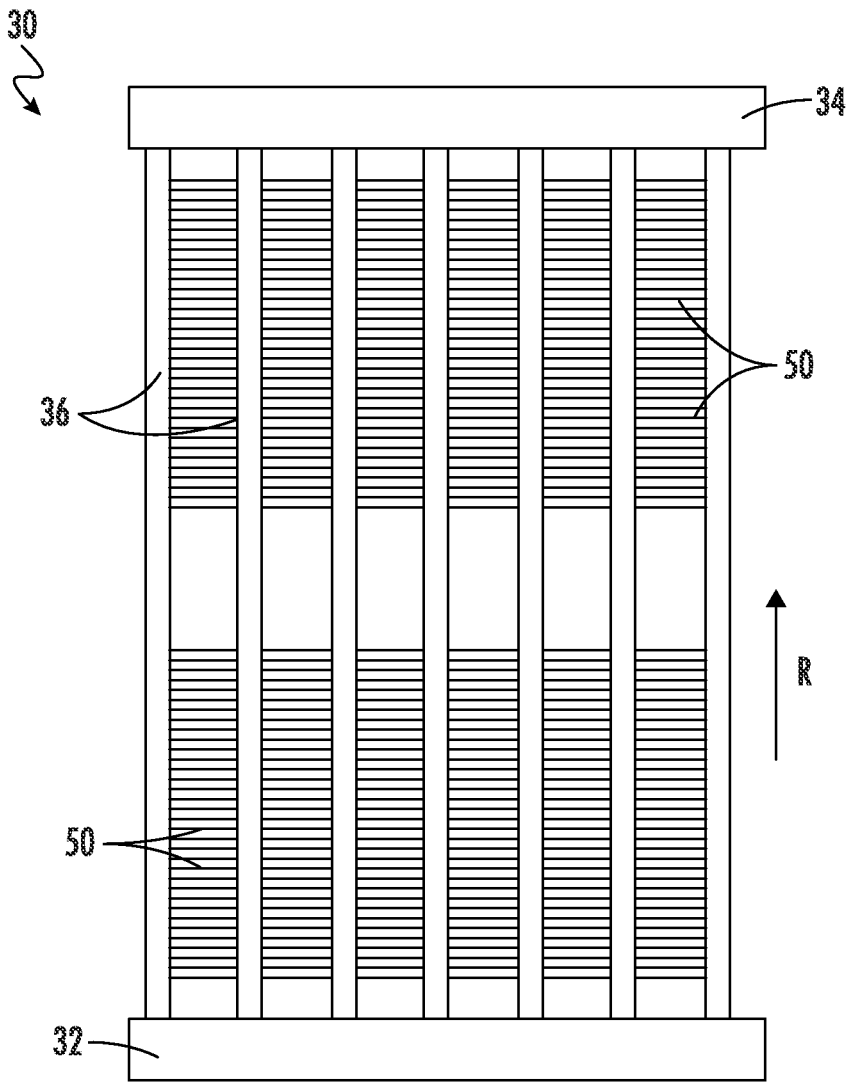
FIG. 2 is a front view of a heat exchanger for use in the heating, ventilation, air conditioning, and refrigeration system according to an embodiment.

Referring now to FIG. 2, an example of heat exchanger 30 suitable for use as either a condenser 26 or an evaporator 24 is illustrated in more detail. The heat exchanger 30 includes at least a first manifold or header 32, a second manifold or header 34 spaced apart from the first manifold 32, and a body defined by a plurality of heat exchange tube segments 36 extending in a spaced, parallel relationship between and connecting the first manifold 32 and the second manifold 34. In the illustrated, non-limiting embodiments, the first header 32 and the second header 34 are oriented generally along a first direction and the heat exchange tube segments 36 extend generally along a second direction between the two headers 32, 34.

Figure 3:
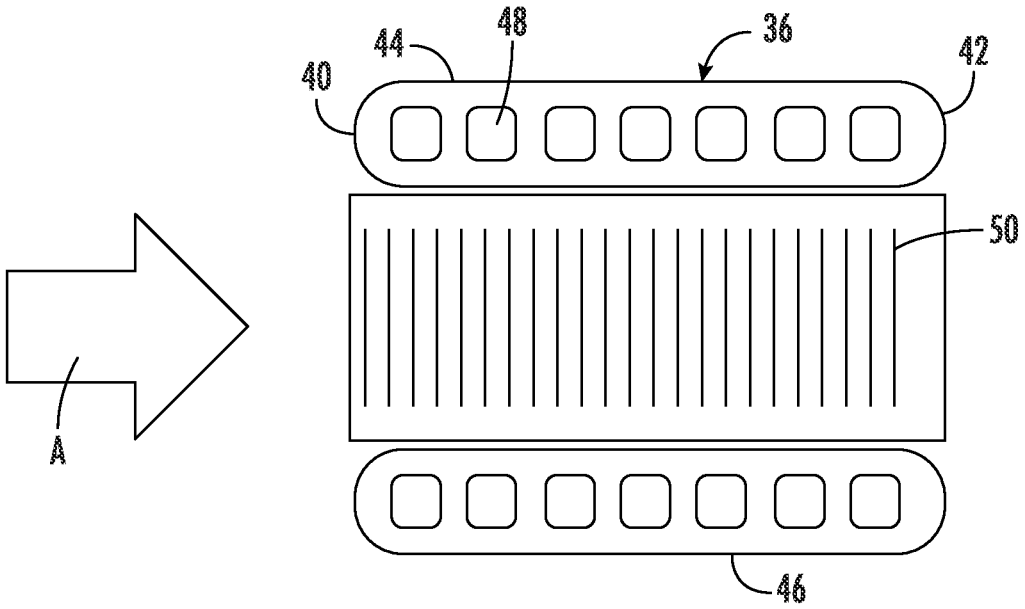
FIG. 3 is a cross-sectional view of a heat exchange tube and fin segment of the heat exchanger of FIG. 2 according to an embodiment.

Referring now to FIG. 3, a cross-sectional view of a portion of a heat exchange tube segment 36 of the heat exchanger 30 is illustrated according to an embodiment. As shown, the heat exchanger 30 may be a microchannel heat exchanger such that the heat exchange tube segments 36 include a flattened microchannel heat exchange tube having a leading edge 40, a trailing edge 42, a first surface 44 and a second surface 46. The leading edge 40 of the heat exchange tube segment 36 is upstream of its respective trailing edge 42 with respect to airflow A passing through the heat exchanger 30 and flowing across the heat exchange tube segment 36. An interior flow passage of the heat exchange tube segment 36 may be divided by interior walls into a plurality of discrete flow channels 48 that extend over a length of the heat exchange tube segment 36 from an inlet end to an outlet end and establish fluid communication between the first and second manifolds 32, 34. The flow channels 48 may have a circular cross-section or, for example, a rectangular cross-section, a trapezoidal cross-section, a triangular cross-section or another non-circular cross-section. The heat exchange tube segment 36 including discrete flow channels 48 may be formed using known techniques and materials, including but not limited to, extruding or folding.

The heat exchange tube segments 36 disclosed herein include a plurality of fins 50. In some embodiments, the fins 50 are formed from a continuous strip of fin material folded in a ribbon-like serpentine fashion thereby providing a plurality of closely spaced fins 50 that extend generally orthogonally to the heat exchange tube segments 36. Thermal energy exchange between one or more fluids within the heat exchange tube segments 36 and an air flow A occurs through the outside surfaces 44, 46 of the heat exchange tube segments 36 collectively forming a primary heat exchange surface, and also through thermal energy exchange with the fins 50, which defines a secondary heat exchange surface.

One or more folds may be formed in each heat exchange tube segment 36 of the heat exchanger 30. The heat exchange tube segments 36 are typically folded about an axis extending perpendicular to the longitudinal axis of the heat exchange tube segments 36. In the illustrated, non-limiting embodiment of FIG. 4, the heat exchange tube segments 36 have a first fold and a second fold formed therein, such that the heat exchanger 30 has a generally C or U shape. However, it should be understood that embodiments of the heat exchanger 30 having another number of folds formed therein, such as a single fold, more than two folds, or alternatively, no folds, are also within the scope of the disclosure. Further, the two portions of the heat exchanger 30 arranged at opposite sides of a fold axis may be oriented at any suitable angle relative to one another. For example, in embodiments of the heat exchanger 30 having a C-shape or U-shape, the two sides of each fold are oriented at approximately 90 degrees or generally perpendicular to one another. However, a fold having an angle greater than 90 degrees, such as up to about 180 degrees for example, or less than 90 degrees is also contemplated herein.

Figure 4:
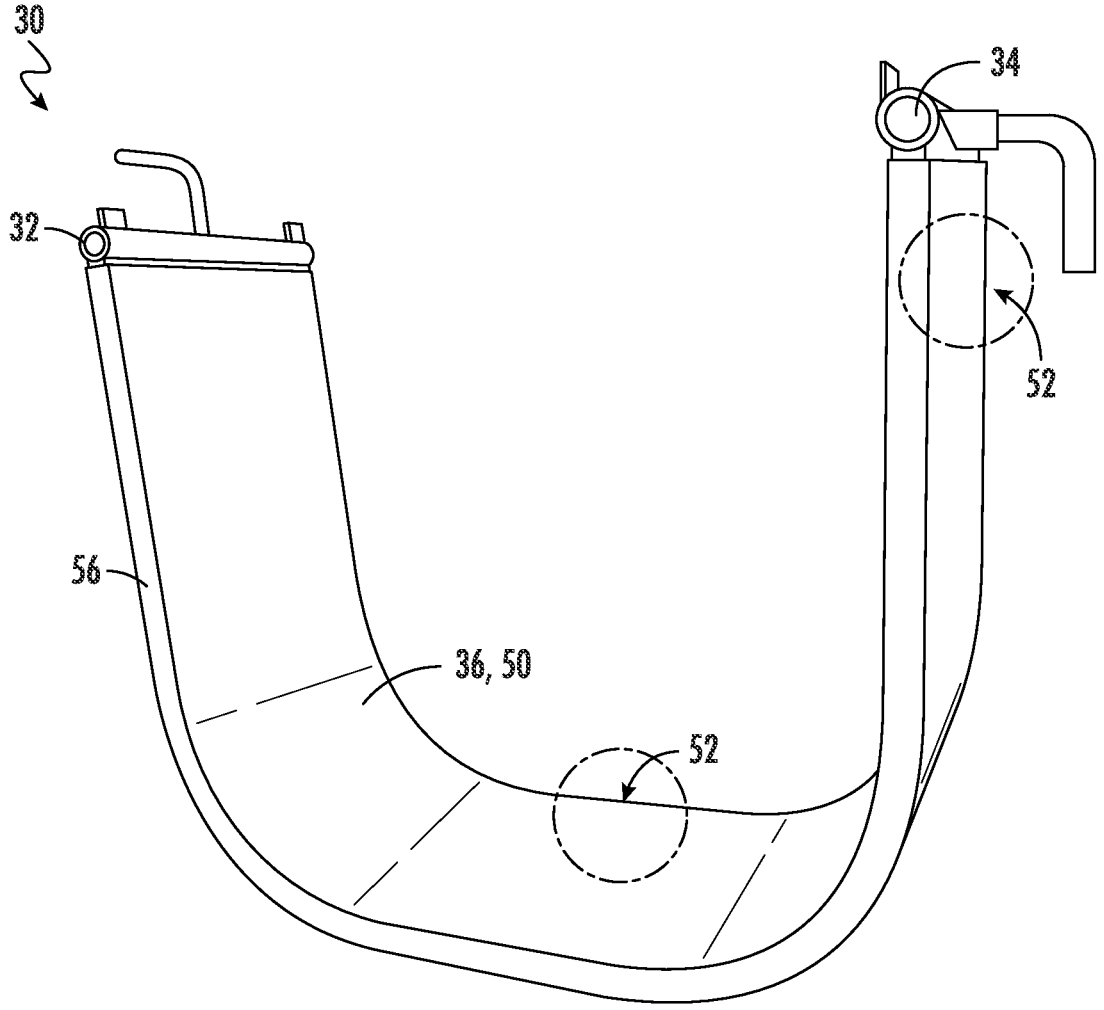
FIG. 4 is a perspective view of folded heat exchanger according to an embodiment.

With continued reference to FIG. 4 and further reference to FIGS. 5-8, one or more openings 52 may be formed in the body of the heat exchanger 30. The one or more openings 52 may extend through the body of the heat exchanger 30 in the same plane as the airflow A at a portion of the heat exchanger 30 directly adjacent to the opening 52. As previously noted, all or at least a portion of the plurality of heat exchange tube segments 36 have a generally linear configuration and are arranged generally parallel to one another.

Figure 5:
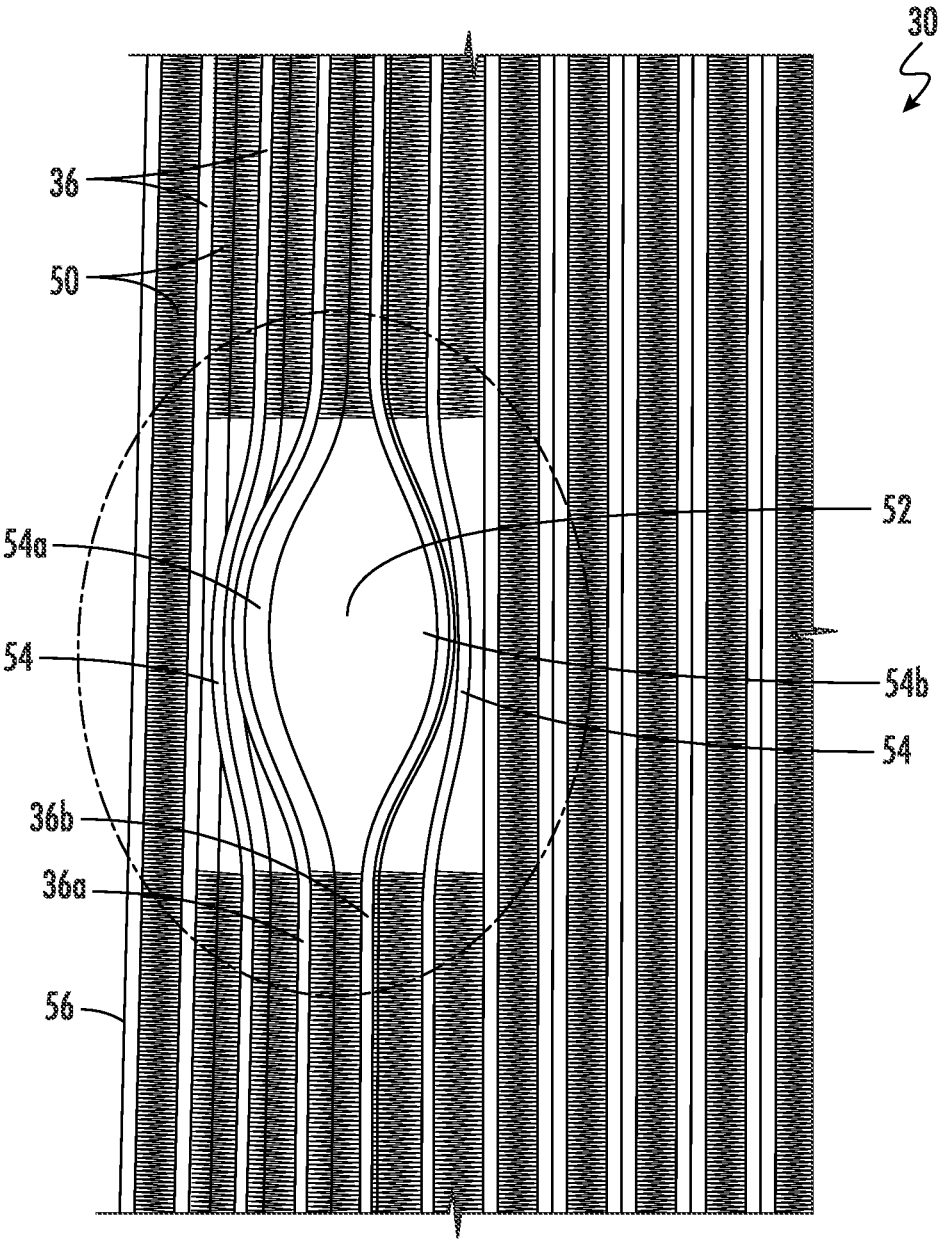
FIG. 5 is a detailed perspective view of a portion of the heat exchanger of FIG. 4 according to an embodiment.

In an embodiment, a section 54 of at least one of the plurality of heat exchange tube segments 36, as best shown in FIG. 5, is bent out of the plane containing of the longitudinal axis of the heat exchange tube segment 36 to form an opening 52 in the body of the heat exchanger 30. For example, a first heat exchange tube segment 36*a* and a second heat exchange tube segment 36*b* located directly adjacent to one another include an aligned first section 54*a* and a second section 54*b*, respectively. The first section 54*a* is bent in a first direction away from the second heat exchange tube segment 36*b* and the second section 54*b* is bent in a second opposite direction, away from the first heat exchange tube segment 36*a*. In such embodiments, the opening 52 formed in the body of the heat exchanger 30 is therefore defined by the gap formed between the first section 54*a* and the second section 54*b* in combination.

In an embodiment, a section of one or more additional heat exchange tube segments 36, such as the heat exchange tube segments 36 located directly adjacent to the first heat exchange tube segment 36*a* and/or the second heat exchange tube segment 36*b*, respectively, may also be bent to accommodate the bend of the first section 54*a* and the second section 54*b*. However, it should be understood that the total number of heat exchange tube segments 36 that are bent to form the opening 52 is dependent on the size of the opening 52 being formed. Embodiments where a portion of only a single heat exchange tube segment 36 is bent to form an opening 52 are within the scope of the disclosure.

To accommodate the bent section 54 of one or more of the plurality of heat exchange tube segments 36, in an embodiment, fins 50 are not affixed to the portion or section 54 of the heat exchange tube segments 36 that are configured to bend to form an opening 52. In the illustrated, non-limiting embodiment, no fins 50 are arranged at either side of the one or more bent sections 54 of the plurality of heat exchange tube segments 36. However, embodiments where the fins 50 are removed from only a single side of a bent section 54, or alternatively, from only a portion of a side of a bent section 54 of a heat exchange tube segment 36 are contemplated herein.

Figure 6:
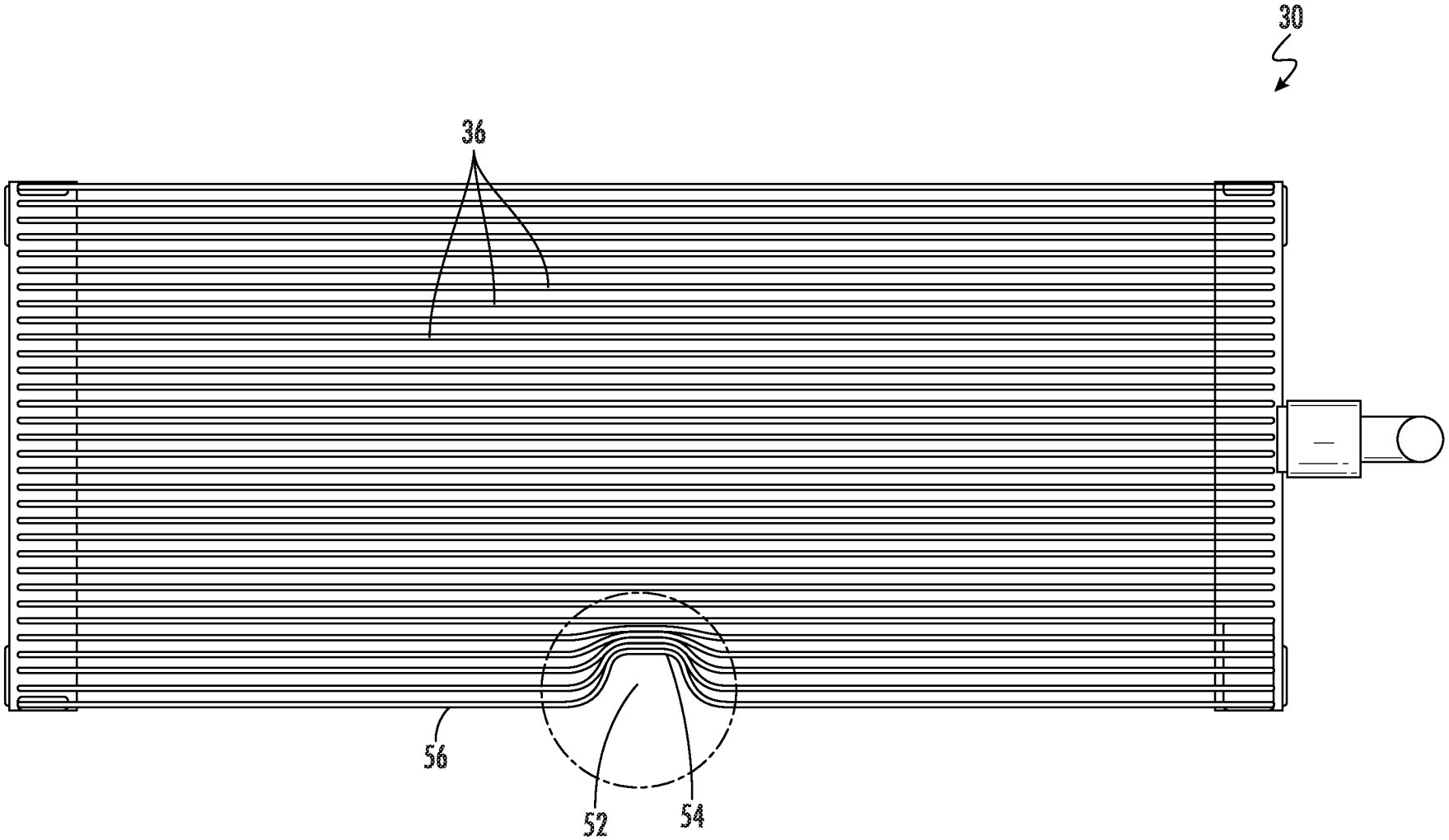
FIG. 6 is a front view of a heat exchanger having an opening formed therein according to another embodiment.

In the illustrated, non-limiting embodiment of FIG. 5, the opening 52 is formed at a central portion of the body of the heat exchanger 30. As used herein, the term "central portion" is intended to describe an area of the heat exchanger 30 that is offset from or does not include an end or outermost tube segment 56 of the plurality of heat exchange tube segments 36. Alternatively, or in addition, as shown in FIG. 6, an opening 52 may be formed at an edge of the body of the heat exchanger 30. In such embodiments, the opening 52 is formed by bending a section of at least an end tube segment 56 of the heat exchanger 30 towards the adjacent heat exchange tube segments 36 of the body of the heat exchanger.

Figure 7:
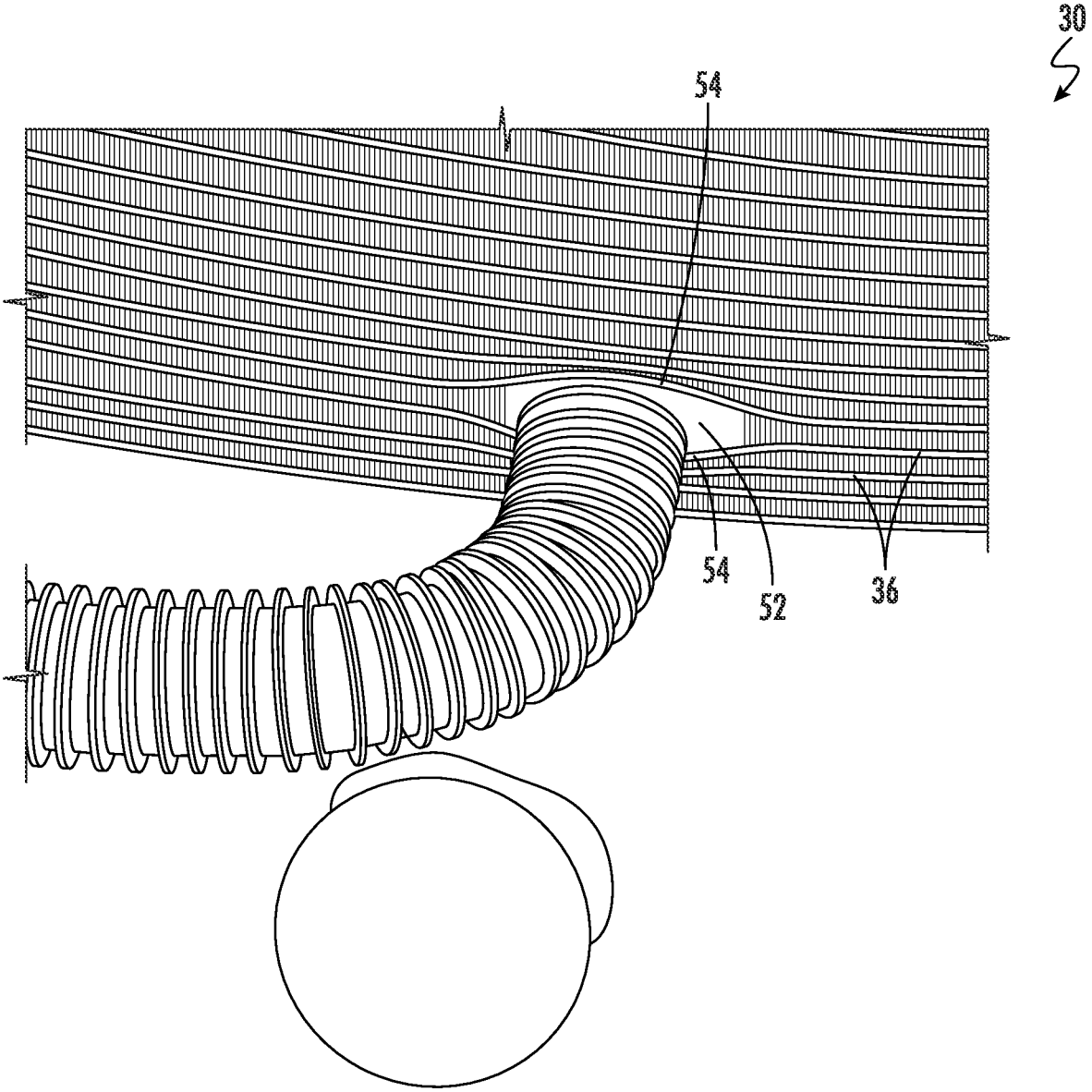
FIG. 7 is a perspective view of a drain pipe extending through an opening formed in a heat exchanger according to an embodiment.
Figure 8:
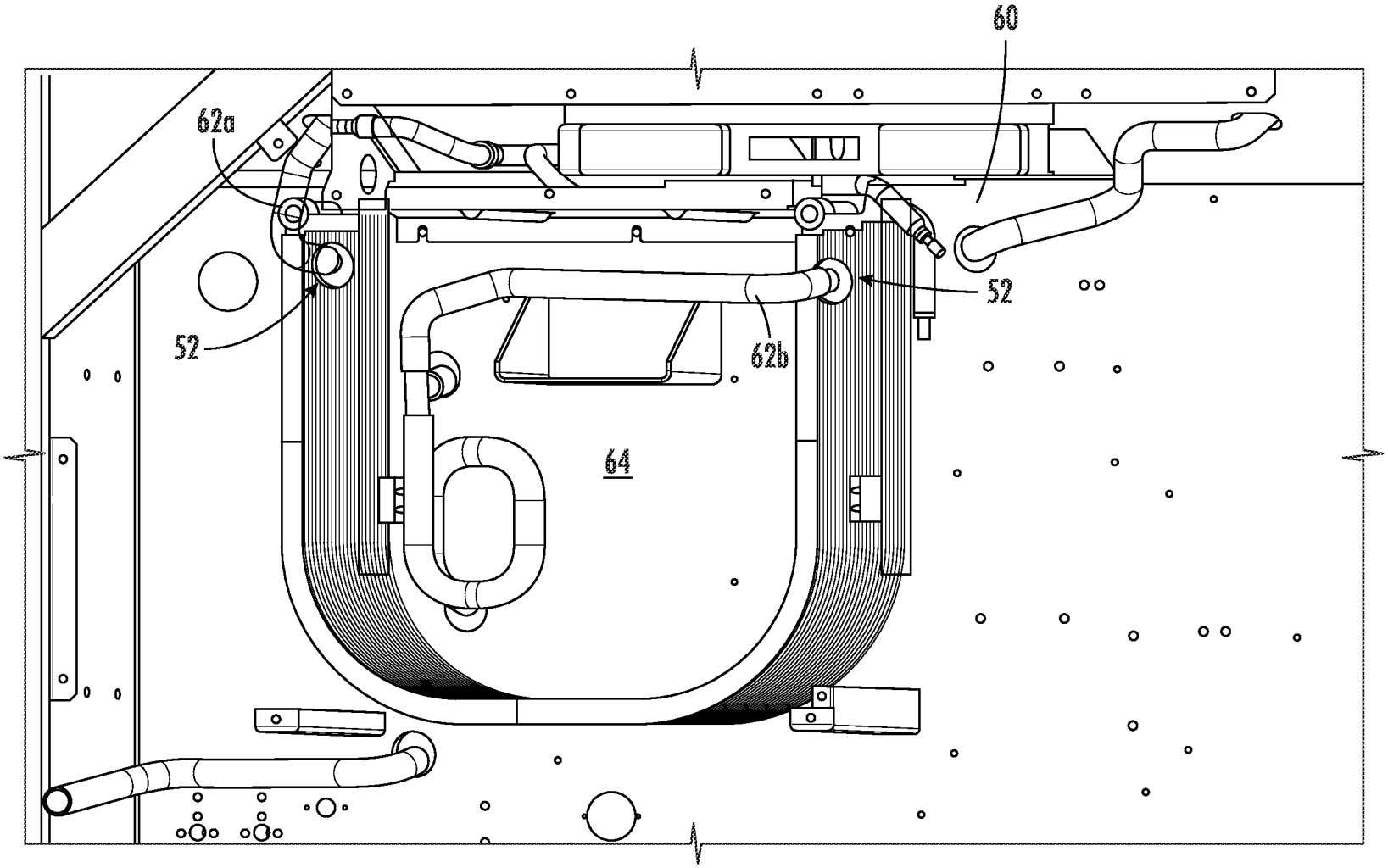
FIG. 8 is a schematic diagram of a heat exchanger having an opening mounted within a refrigeration system of a container refrigeration unit.

A heat exchanger 30 having one or more openings 52 formed in the body thereof may be used as a condenser coil, such as in a transport or container refrigeration unit. With reference to FIGS. 7 and 8, the heat exchanger 30 having one or more openings 52 formed therein may be mounted to a support surface 60, such as a mainframe of the refrigeration system for example. In an embodiment, when the heat exchanger 30 is mounted to the support surface 60, the headers 32, 34 of the heat exchanger 30 are arranged in a horizontal plane, and the plurality of heat exchange tube segments 36 are disposed vertically below the headers 32, 34, such that the mounted heat exchanger 30 has a generally U-shaped configuration. This is distinguishable from the configuration of the tube-fin heat exchangers previously used as a condenser coil in a container refrigeration unit, which typically had a C-shape defined by headers that are vertically aligned and offset from one another. Accordingly, because the heat exchanger 30 is rotated relative to previous condenser coil configuration, one or more of the other components of the refrigeration system, such as a receiver (not shown) and/or the filter drier assembly (not shown) for example, may be relocated, and in some embodiments may be mounted directly to the support surface 60.

With continued reference now to FIGS. 7 and 8, a conduit or pipe 62 may extend through the one or more openings 52 formed in the heat exchanger 30. In the non-limiting embodiment, the conduit 62 is used to part of a drain system used to drain condensate, such as from the refrigeration system and/or from the area being refrigerated for example. As shown in FIG. 8, a first branch 62*a* of conduit 62 may extend through an opening 52 formed at a left-hand side of the body of the heat exchanger 30, near a first header 32, and a second branch 62*b* of conduit 62 may extend through an opening 52 formed at a right-hand side of the body of the heat exchanger 30, near the second, opposite header 34 for example. The first and second branches 62*a*, 62*b* may join together within an internal area or space 64 defined between the sides of the body of the heat exchanger 30. In some embodiments, the conduit additionally extends from the internal area 64 through another opening 52 formed in the generally horizontally oriented portion of the body of the heat exchanger 30 to an outlet. However, in other embodiments, the conduit 62 may be routed from the internal area 64 through the support surface 60 to an outlet. It should be understood that the configuration of the drain conduit and the openings 52 formed in the heat exchanger 30 illustrated and described herein are intended as an example only. A heat exchanger 30 having openings 52 at any position suitable for use with a drain system of a refrigeration system or unit is contemplated herein.

In addition, it has been determined that bending a section 54 of one or more of the heat exchange tube segments 36 has a minimal or negligible impact on the operation of the heat exchanger 30. Accordingly, the drain conduit 62 may extend through one or more openings 52 formed in the heat exchanger 30 without substantially affecting operation of the HVAC&R system. With this configuration of the heat exchanger 30 and drain conduit 62, there is no longer a need to route the conduit 62 behind the mainframe 60 via a pair of holes formed at opposite sides of the body of the heat exchanger 30. As a result, the overall design of the mainframe 60 may be simplified, such as by eliminating the need for 2-6 holes formed in the mainframe 60, drain fittings and sealant application. Further, this reduction in complexity may similarly result in a cost reduction. A heat exchanger 30 having one or more openings 52 formed therein is also suitable for use in retro-fit applications.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A refrigeration system comprising:

a support surface;

a microchannel heat exchanger mounted to the support surface, the heat exchanger including a body and an opening formed in the body, the body of the heat exchanger includes a plurality of heat exchange tube segments arranged in spaced parallel relationship and fluidly coupling a first manifold and a second manifold and the opening is defined by at least one of the plurality of heat exchange tube segments; and a drain system associated with the support surface, wherein a portion of the drain system extends through the opening of the heat exchanger in a plane of an air flow of passing through the heat exchanger body.

2. The refrigeration system of claim 1, wherein the drain system includes a conduit extendable through the opening of the heat exchanger.

3. The refrigeration system of claim 1, wherein a bent section of at least one of the plurality of heat exchange tube segments is bent out of a plane of the at least one of the plurality of heat exchange tube segments, the opening being defined by the bent section of the at least one of the plurality of heat exchange tube segments.

4. The refrigeration system of claim 1, wherein the opening is arranged at a central portion of the body of the heat exchanger.

5. The refrigeration system of claim 1, wherein the opening is arranged at an edge of the body of the heat exchanger.

6. The refrigeration system of claim 1, wherein the refrigeration system is a container refrigeration unit.

7. The refrigeration system of claim 1, wherein the heat exchanger is configured to operate as a condenser in a container refrigeration unit.

8. The refrigeration system of claim 1, wherein at least one fold is formed in the plurality of heat exchange tube segments, the fold being defined about an axis extending generally perpendicular to a longitudinal axis of the plurality of heat exchange tube segments.

9. The heat exchanger of claim 8, wherein the at least one fold includes a first fold and a second fold such that the body of the heat exchanger is generally U-shaped.

* * * * *